US005429017A

United States Patent [19]

Junkers

[11] Patent Number: 5,429,017

[45] Date of Patent: Jul. 4, 1995

[54] FLUID-OPERATED TORQUE TOOL

[76] Inventor: John K. Junkers, 7 Arrowhead La., Saddle River, N.J. 07540

[21] Appl. No.: 112,770

[22] Filed: Aug. 26, 1993

Related U.S. Application Data

[63] Continuation-in-part of Ser. No. 812,629, Dec. 23, 1991, abandoned.

[51] Int. Cl.[6] ..... B25B 13/00

[52] U.S. Cl. ..... 81/57.44; 81/57.4

[58] Field of Search ..... 81/54, 57.4, 57.42, 81/57.44

[56] References Cited

U.S. PATENT DOCUMENTS

| | | | |
|---|---|---|---|
| 4,141,261 | 2/1979 | Tummel | 81/57.44 X |
| 4,233,865 | 11/1980 | Junkers | 81/57.44 |
| 4,513,644 | 4/1985 | Weyer | 81/57.39 |
| 4,753,139 | 6/1988 | Junkers | 81/57.44 X |

FOREIGN PATENT DOCUMENTS

| | | | |
|---|---|---|---|
| 8203715 | 9/1983 | France | 81/57.44 |
| 324992 | 9/1920 | Germany | 81/57.44 |

*Primary Examiner*—James G. Smith
*Attorney, Agent, or Firm*—Michael J. Striker

[57] ABSTRACT

A fluid-operated torque tool for tightening and loosening threaded connectors has an engaging element having an axis and two axial ends with at least one of the ends adapted to engage a threaded connector to be tightened or loosened, and a driving element which is displaceable under the action of a working fluid in an axial direction of the engaging element and engages with the engaging element so that during the axial displacement of the driving element the engaging element turns about the axis and therefore tightens or loosens a threaded connector engaged by the engaging element.

6 Claims, 3 Drawing Sheets

FLUID-OPERATED TORQUE TOOL

CROSS-REFERENCE TO RELATED APPLICATION

This application is a continuation-in-part of U.S. patent application Ser. No. 812,629 filed on Dec. 23, 1991, abandoned.

BACKGROUND OF THE INVENTION

The present invention relates to a fluid-operated torque tool for tightening and loosening threaded connectors such as bolts, nuts and the like.

Fluid-operated torque tools of the above mentioned general type are known in the art and widely utilized. In known fluid-operated torque tools the tool works substantially perpendicular to the drive axis. In other words, when a fluid-operated torque tool has an engaging element which engages said threaded connector, and a drive formed as a fluid-operated cylinder-piston unit, the piston of the drive is displaced in an axial direction of the cylinder-piston unit, while the engaging element of the tool turns about an axis which is perpendicular to the axis of the cylinder-piston unit. The known tools of this type can be improved.

SUMMARY OF THE INVENTION

Accordingly, it is an object of the present invention to provide a fluid-operated torque tool which avoids the disadvantages of the prior art.

In keeping with these objects and with others which will become apparent hereinafter, one feature of the present invention resides, briefly stated, in a fluid operated torque tool which has an engaging element having an axis and two axial ends with at least one of the ends adapted to engage a threaded connector to be tightened or loosened, and a driving element which is displaceable under the action of a working fluid in an axial direction of the engaging element and engaging with the engaging element so that during the axial displacement of the driving element the engaging element turns about the axis and therefore tighten or loosen a threaded connector engaged by the engaging element.

When the fluid-operated torque tool is designed in accordance with the present invention it has a simple construction and requires a very few parts. The inventive tool has also relatively small diameter. At the same time it is extremely powerful since a piston area obtained in the inventive tool takes up little space, yet it is larger than if a single cylinder-piston type drive is used.

In accordance with another feature of the present invention the fluid-operated torque tool has means for engaging the driving element with the engaging element and including helical projections and grooves provided in the elements and engaging with one another.

Still a further feature of the present invention is that the fluid-operated torque tool in accordance with the present invention has a stationary member with a plurality of teeth spaced from one another in a direction transverse to the axis, a ring-shaped ratchet which is turnable relative to the engaging element and is provided with a plurality of counter teeth also spaced in the direction transverse to the axis and engageable with the teeth of the stationary member, and the driving element engages with and at the same time is axially movable relative to the ratchet, so that upon engaging of the teeth of the ratchet with the teeth of the stationary member the driving element continues to move axially relative to the ratchet and relative to the engaging element under the action of fluid.

In accordance with another feature of the invention, the fluid-operated torque tool the driving element includes two driving members engageable wit the engaging element and movable axially relative to the engaging element so that when driving members move successively one after another relative to the engaging element under the action of the working fluid the engaging element rotates in the same direction.

Still another feature of the present invention is that in the fluid-operated torque tool the engaging element as two sections located near one another in an axial direction and provided with helical formations inclined in opposite directions, the driving members have helical counter formations which engage with the formations of the engaging element and are inclined in different directions, so that the engaging element is rotated in the same direction when one of driving members is axially displaceable in one axial direction and the other of the driving members is axially displaceable in the opposite axial direction.

Another feature of the present invention is that in the fluid-operated torque tool the driving members of the driving element are turnable relative to one another.

Still an additional feature of the present invention is that the fluid-operated torque tool there is means for connecting portions of the driving element so that they are axially displaceable relative to one another, and the connecting means include interengaging splines.

In accordance with a further feature of the present invention the fluid-operated torque tool has means forming a fluid cylinder for admitting the working fluid and displacing the driving element axially relative to the engaging element.

Finally, it is still a further feature of the present invention that the fluid-operated torque tool has means forming a cylinder adapted to receive the working fluid and to apply it alternatingly to the driving members so as to displace driving members axially in the two axial directions.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
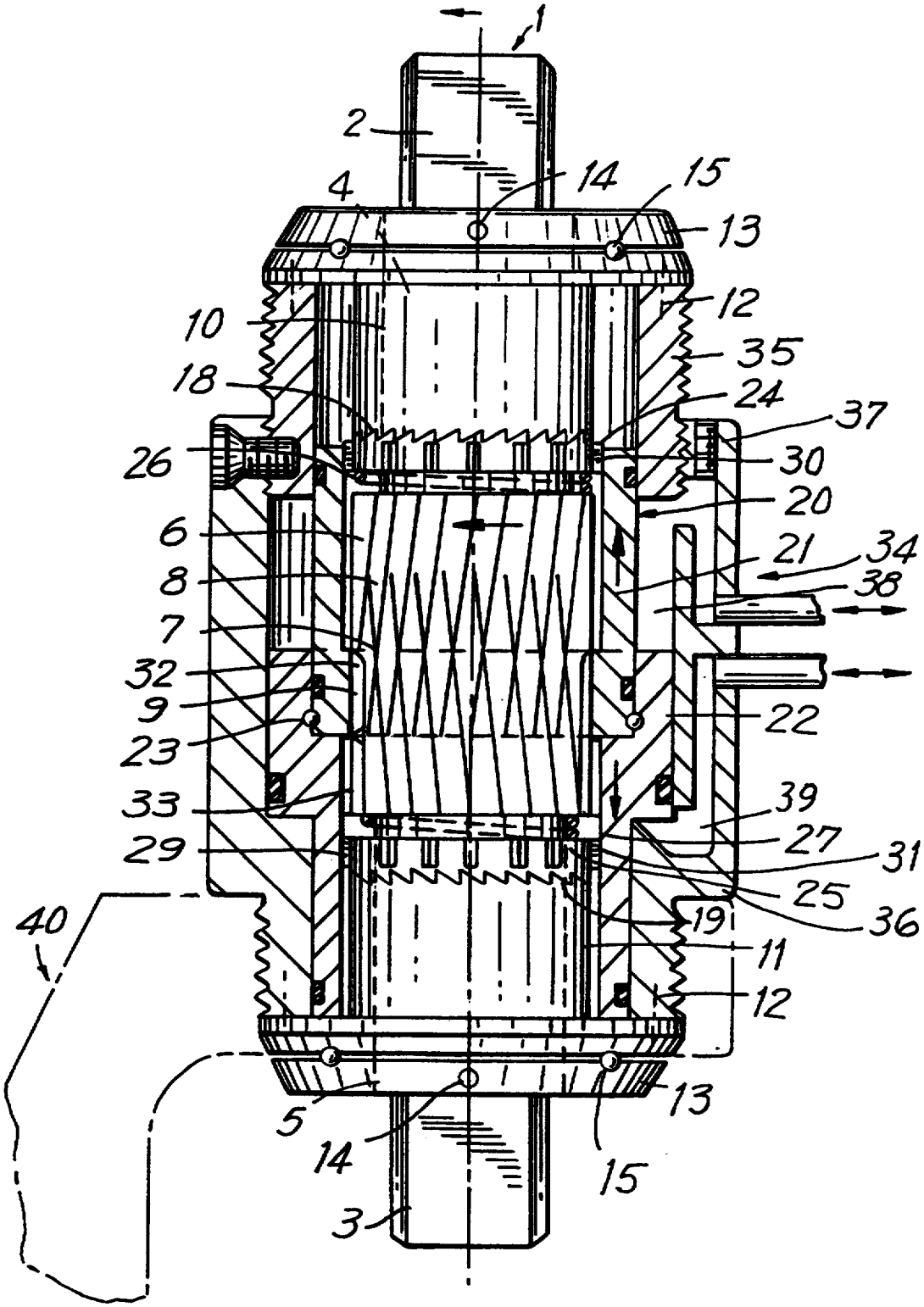
FIG. 1 of the drawings is a view schematically showing a partial cross-section of a fluid-operated torque tool in accordance with the present invention.
Figure 2:
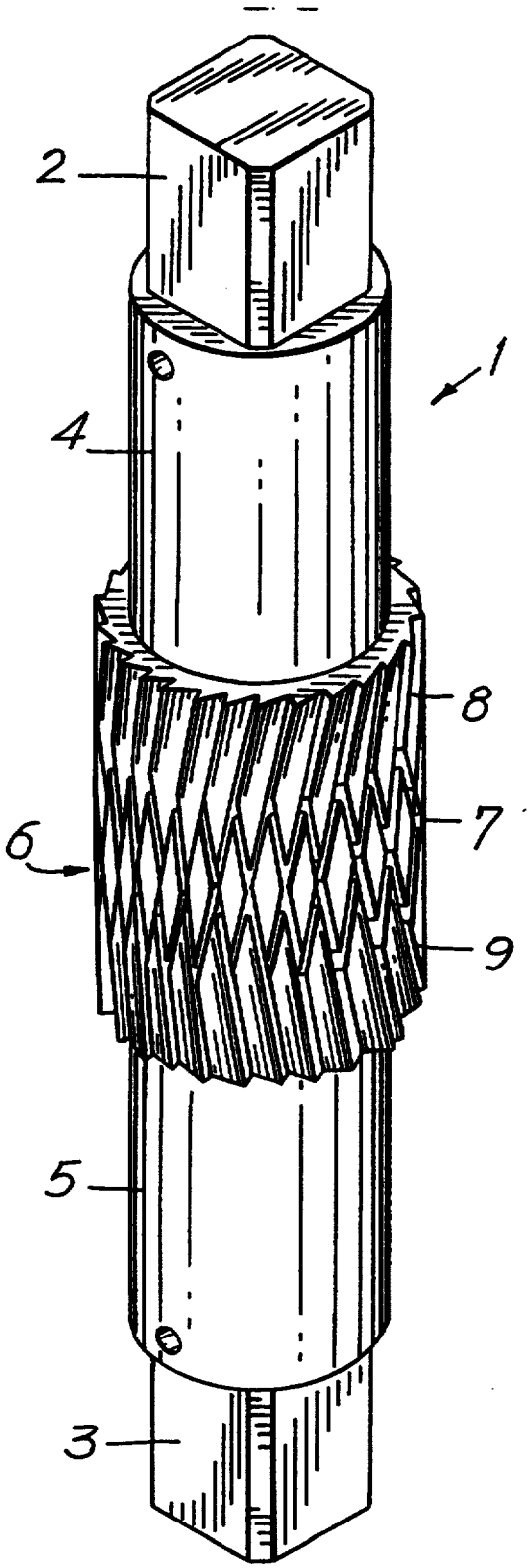
FIG. 2 is a view showing an engaging element of the inventive tool.
Figure 3:
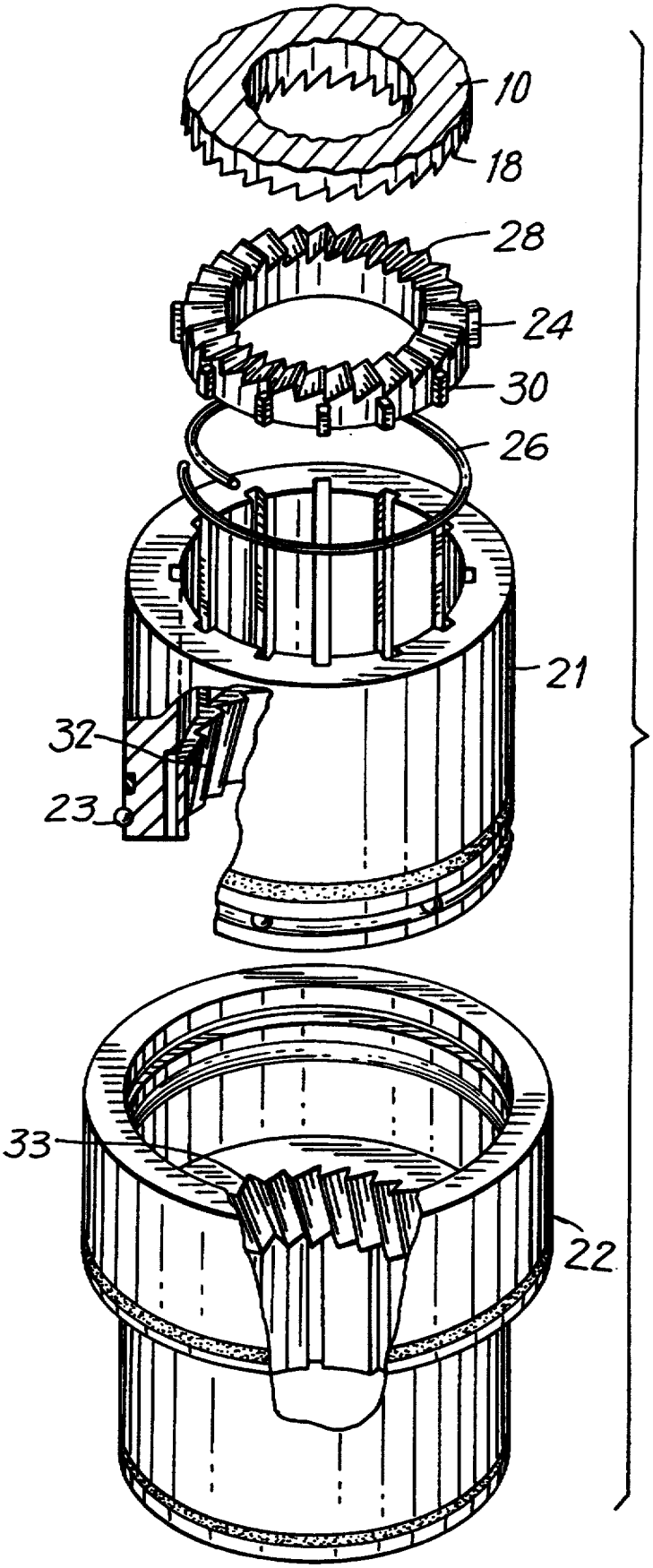
FIG. 3 is an exploded view showing a driving element and ratchets of the inventive tool.

A fluid-operated torque tool in accordance with the present invention has an engaging element which is identified as a whole with reference numeral 1. The engaging element 1 is formed as an elongated stepped cylindrical shaft which has two end portions 2 and 3 each adapted to engage a threaded connector to be tightened or loosened. For example, the end portions 2 and 3 are formed as rectangular or hexagonal members engageable into rectangular or hexagonal openings of sockets to be connected with a threaded connector. The engaging element 1 further has two portions 4 and 5 of a greater diameter. Finally, it has a central cylindrical portion located between the portions 4 and 5. The central portion is identified with reference numeral 6 and has two sections provided with helical formations formed for example as helical teeth, which are inclined in opposite directions. In other words, starting from a central line 7 of the portion 6 helical formations 8 are inclined from the bottom left toward the top right, while helical projections 9 are inclined from top left toward the bottom right.

Bushings 10 and 11 are arranged on the portions 4 and 5 of the engaging element and fixedly connected with the housing of the tool for example by screws 12. The engaging element 1 turns relative to the bushings 10 and 11. Retaining members 13 retain all parts of the tool together and are connected to the shaft fixedly for example by pins 14.

The retaining members 13 are turnable relative to the bushings 10 and 11 due to interposition of bearings 15 between them, formed for example by balls. The inner ends of the bushings are provided with a plurality of teeth 18 and 19 which are spaced from one another in a circumferential direction transversely to the axis A of the engaging element 1 and inclined in opposite directions.

A driving element is identified as a whole with reference numeral 20. It has two driving members 21 and 22 which are connected with one another for example through a bearing 23 formed by balls, so that they are jointly axially displaceable and at the same time can rotate relative to one another. The tool further has ring-shaped ratchets 24 and 25 which are arranged turnably relative to the driving element and are spring biased in an axial direction toward the bushings 10 and 11 by springs 26 and 27. The ratchets are provided with teeth 28 ad 29 which are engageable with the teeth 18 and 19 of the bushings 10 and 11. The driving member 21 is connected with the ratchet 24 by interengaging formations, for example splines, so that it can axially displace relative to the ratchet 24 and therefore relative to the engaging element 1. The driving member 22 is likewise connected with the ratchet 25 by interengaging formations such as spline 31 so that it also can axially move relative to the ratchet 25 and therefore relative to the engaging element 1. The driving members 1 and 22 have radially inwardly extending projections 32 and 33 which are provided with helical formations formed for example as helical teeth. The helical formations of the projections 32 and 33 are inclined in opposite directions and formed in correspondence with the helical projections 8 and 9 of the engaging element 1, so as to engage the latter.

The tool also has a housing which is identified as a whole with reference numeral 34. The housing has two housing portions 35 and 36 which are connected with one another for example by a thread 37. The housing has two chambers 38 and 39 which do not communicate with one another. Working fluid, such as for example hydraulic fluid can be alternatingly admitted into and withdrawn from the chambers 38 and 39.

The fluid-operated tool in accordance with the present invention operates in the following manner.

When the working fluid, for example hydraulic liquid is admitted from a not shown source to the chamber 39 the driving member 22 is pushed upwardly in the drawings and pushes upwardly the driving member 21. Since the teeth 26 of the ratchet 24 engages with the teeth 18 of the bushing 10, the driving member 21 cannot turn and instead moves axially upwardly relative to the ratchet 24 and relative to the engaging element 1. Since the helical formations 32 of the driving member 21 engage with the helical formations 8 of the engaging element 1, the axial upward displacement of the driving member 21 causes turning of the engaging element 1 in a predetermined direction identified by the arrow. During this upward axial displacement the driving member 22 can turn relative to the driving member 21 and just follows by its helical formation 33 the helical formations 9 of the engaging element 1 while the teeth 29 of the ratchet 25 just slip over the teeth 19 of the bushing 11.

When thereafter the fluid is withdrawn from the chamber 39 and admitted into the chamber 38, the driving members 21 and 22 move axially downwardly. Since the teeth 29 of the ratchet 25 engage with the teeth 19 of the bushing 11, the driving member 22 cannot rotate and displaces axially downwardly relative to the ratchet 25 and relative to the engaging element 1. Due to the engagement of the helical formations 33 of the driving member 22 with the helical formations 9 of the engaging element 1, the engaging element 1 is turned in the same direction, while the driving member 21 turns relative to the driving member 22 and the teeth 28 of the ratchet 24 slip over the teeth 18 of the bushing 10. Therefore a continuous turning of the shaft is provided. In this way a fastener can be for example tightened. In order to reverse the tool from tightening to loosening, the tool is urned over so that the upper end of the engaging element 1 is engaged with the fastener.

The fluid-operated torque tool is further provided with a reaction member which is identified with reference numeral 40. The reaction member has inner splines 41 which engage with outer splines 42 provided on both end parts of the housing. The reaction member as known can .abut against the neighboring objects, for example a side of a flange, an adjacent nut, a base of a housing of the application. The reaction member can be removed from one axial side of the housing and attached to the other axial end of the housing, during respective operations.

It is to be understood that the inventive fluid-operated torque tool can also operate with the central part 6 of the shaft 1 provided with one-directional helical formations and with a single driving element provided with a respective helical formation. In this case the driving element with the helical formation would turn the shaft in one direction, and the ratchet backwards in the opposite direction without turning the tool.

In the shown embodiment the housing is formed as a cylinder having fluid-receiving chambers. It is believed to be clear that the cylinder can be arranged separately from the tool on top of it and operated so that it can be switched from one side to another side. However, this would make the tool longer.

When the fluid-operated torque tool is designed in accordance with the preset invention it has a simple construction and requires very few parts. It also has a relatively small diameter and at the same time is extremely powerful since the piston area provided in this tool takes up little space, and is yet larger than in tools with cylinder-piston units.

It will be understood that each of the elements described above, or two or more together, may also find a useful application in other types of constructions differing from the types described above.

While the invention has been illustrated and described as embodied in a fluid-operated torque tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

I claim:

1. A fluid-operated torque tool for tightening and loosening threaded connectors, comprising an engaging element having an axis and two axial ends with both of said ends formed to engage a threaded connecter to be tightened or loosened; a driving element which is displaceable under the action of a working fluid in an axial direction of said engaging element and engages with said engaging element so that during the axial displacement of said driving element said engaging element turns about said axis and therefore tightens or loosens a threaded connector engaged by said engaging element; and means for engaging said driving element with said engaging element and including helical projections and grooves provided in said elements and engaging with one another.

2. A fluid-operated torque tool for tightening and loosening threaded connectors, comprising an engaging element having an axis and two axial ends with at least one of said ends formed to engage a threaded connector to be tightened or loosened; a driving element which is displaceable under the action of a working fluid in an axial direction of said engaging element and engages with said engaging element so that during the axial displacement of said driving element said engaging element turns about said axis and therefore tightens or loosens a threaded connector engaged by said engaging element; and an immovable member provided with a plurality of teeth spaced from one another in a direction transverse to said axis; a ratchet turnable relative to said engaging element and provided with counter-teeth which are also spaced in a direction transverse to said axis and engageable with said teeth of said stationary member, said driving element being engaged with and at the same time axially movable relative to said ratchet, so that upon engaging said teeth of said ratchet with said teeth of said stationary member said driving element continues to move axially relative to said ratchet and relative to said engaging element under the action of fluid.

3. A fluid-operated torque tool as defined in claim 2; and further comprising means for connecting said driving element with said ratchet so that said driving element is axially displaceable to said ratchet, said connecting means including interengaging splines.

4. A fluid-operated torque tool as defined in claim 3; further comprising means for forming a cylinder adapted to receive the working fluid and to apply it alternatingly to said driving members so as to displace said driving members axially in said two axial directions.

5. A fluid-operated torque tool for tightening and loosening threaded connectors, comprising an engaging element having an axis and two axial ends with at least one of said ends formed to engage a threaded connector to be tightened or loosened; and a driving element which is displaceable under the action of a working fluid in an axial direction of said engaging element and engages with said engaging element so that during the axial displacement of said driving element said engaging element turns about said axis and therefore tightens or loosens a threaded connector engaged by said engaging element, wherein said driving element includes two driving members engageable with said engaging element and movable jointly axially relative to said engaging element so that when said driving members move jointly relative to said engaging element under the action of the working fluid consecutively in two opposite directions, said engaging element rotates in the same direction, said engaging element having two sections located near one another in an axial direction and provided with helical formations inclined in opposite directions, said driving members having helical counter formations which engage with said formations of said engaging element and are inclined in different directions, so that said engaging element is rotated in the same direction when one of said driving members is axially displaceable in one axial direction and the other of said driving members is axially displaceable in the opposite axial direction.

6. A fluid-operated torque tool as defined in claim 5; and further comprising means for connecting said driving members with one another so that said driving members of said driving element are turnable relative to one another.

* * * * *